US006379168B1

(12) United States Patent
Wang

(10) Patent No.: US 6,379,168 B1
(45) Date of Patent: Apr. 30, 2002

(54) CARD EDGE CONNECTOR WITH SWITCH TYPE RETAINER

(75) Inventor: Lanyi Wang, Kunsan (CN)

(73) Assignee: Hon Hai Precision IND Co., Ltd., Taipei Hsein (TW)

( * ) Notice: Subject to any disclaimer, the term of this patent is extended or adjusted under 35 U.S.C. 154(b) by 0 days.

(21) Appl. No.: 10/011,019

(22) Filed: Dec. 4, 2001

(51) Int. Cl.[7] ..... H01R 13/62
(52) U.S. Cl. ..... 439/160; 439/153
(58) Field of Search ..... 439/160, 155, 439/153, 157

(56) References Cited

U.S. PATENT DOCUMENTS 4,898,540 A * 2/1990 Saito ..... 439/160
5,470,240 A * 11/1995 Suzuki ..... 439/160

* cited by examiner

*Primary Examiner*—Tho D. Ta
(74) *Attorney, Agent, or Firm*—Wei Te Chung

(57) ABSTRACT

A card edge connector includes an insulative housing defining a central slot for receiving a circuit board. A block is formed on an end of the housing and defines a cavity in an outside surface thereof. A socket defined by two opposing arc sections is formed inside the cavity. A switching button includes a pivot and first and second side sections extending from the pivot and inclined with respect to each other. The button is arranged in the cavity with the pivot rotatably received and retained in the socket whereby the button is rotatable about the pivot between a first position where the first side section is moved into the cavity while the second side section is moved out of the cavity and a second position where the first side section is moved out of the cavity while the second side section is moved into the cavity. A latch pin extends from the first side section. The latch pin engages a notch defined in the circuit board when the button is in the first position thereby securing the circuit board in the connector. The latch pin disengages from the notch when the button is in the second position thereby releasing the circuit board from the connector.

14 Claims, 5 Drawing Sheets

CARD EDGE CONNECTOR WITH SWITCH TYPE RETAINER

BACKGROUND OF THE INVENTION

1. Field of the Invention

The present invention generally relates to a card edge connector, and in particular to a card edge connector comprising a switch type retainer for retaining a daughter board in the connector.

2. The Related Arts

A card edge connector connects a daughter board or a card to a mother board. An example of the card edge connector is a connector for connecting an Accelerated Graphics Port (AGP) card to a computer mother board. A conventional card edge connector comprises an insulative housing defining an elongate central slot for receiving an edge of the daughter board. Conductive contacts are retained in the housing and are allowed to engage conductive pads formed on the daughter board.

Such a structure, however, cannot securely retain a daughter board in the card edge connector. Thus, an AGP connector is equipped with a separate retainer for securing the daughter board in the connector. An example of the separate retainer is shown in Taiwan Patent Application No. 86215468. Using the separate retainer to securely retain a daughter board in a card edge connector requires the provision of additional parts and sometimes special tools for installing these additional parts. Costs are of course increased.

Taiwan Patent Application No. 88216650 discloses a card edge connector with a retainer integrally formed with a housing of the connector. An example of such a card edge connector is shown in FIG. 1 wherein a card edge connector generally designated at 1' comprises an elongate housing 10' defining a slot 14' extending in a longitudinal direction thereof for receiving a daughter board or card (not shown). A plurality of conductive contacts 21' are retained in the housing 10' on opposite sides of the slot 14'. The contacts 21' are allowed to extend beyond side surfaces 16' of the slot 14' to engage with the daughter board or card received in the slot 14'. A deflectable arm 22' integrally extends from an end face 19' of the housing 10'. A latch pin 24' extends from the deflectable arm 22' for selectively engaging with a notch or hole defined in the daughter board to secure the daughter board.

The housing 10' and the arm 22' are usually made of synthetic material. In order to be deflectable, the arm 22' must be made thin. Such a thin arm 22' is mechanically weak and can be broken when being over-deflected.

It is thus desirable to provide an improved card edge connector for overcoming the above mentioned problem.

SUMMARY OF THE INVENTION

Accordingly, an object of the present invention is to provide a card edge connector comprising a retainer that requires no deflection in operation so as to avoid damage caused by over-deflection.

Another object of the present invention is to provide a card edge connector comprising a switch type retainer.

A further object of the present invention is to provide a card edge connector comprising a retainer that is easy to operate.

To achieve the above objects, a card edge connector in accordance with the present invention comprises an insulative housing defining a central slot for receiving a circuit board. A block is formed on an end of the housing and defines a cavity in an outside surface thereof. A socket defined by two opposing arc sections is formed inside the cavity. A switching button comprises a pivot and first and second side sections extending from the pivot and inclined with respect to each other. The button is arranged in the cavity with the pivot rotatably received and retained in the socket whereby the button is rotatable about the pivot between a first position where the first side section is moved into the cavity while the second side section is moved out of the cavity and a second position where the first side section is moved out of the cavity while the second side section is moved into the cavity. A latch pin extends from the first side section. The latch pin engages a notch defined in the circuit board when the button is in the first position thereby securing the circuit board in the connector. The latch pin disengages from the notch when the button is in the second position thereby releasing the circuit board from the connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
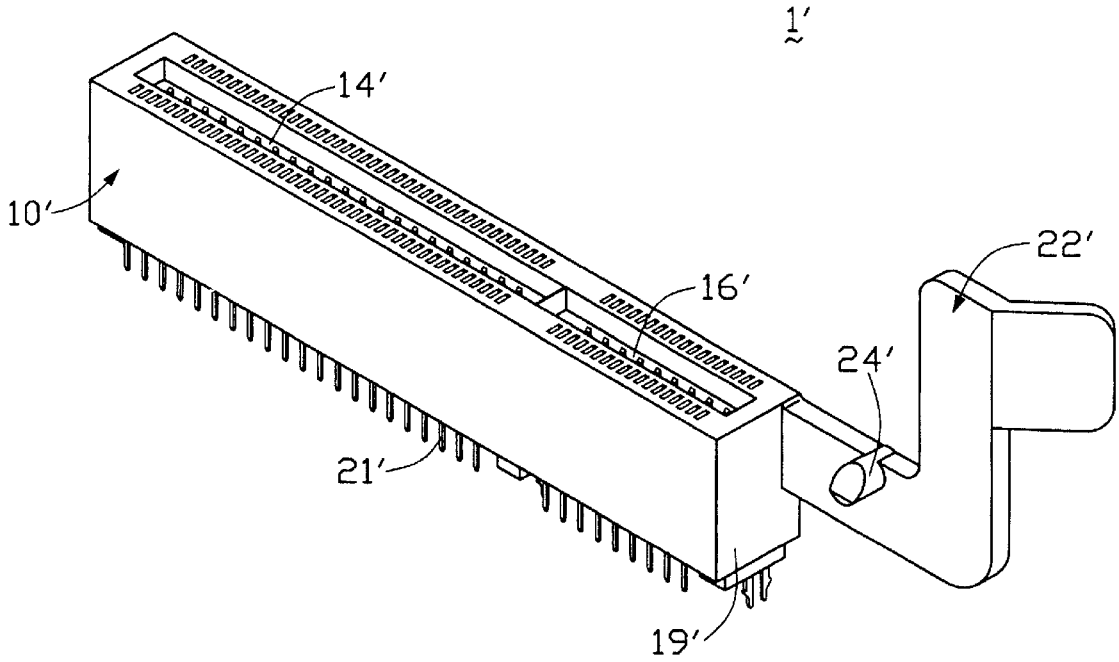
FIG. 1 (PRIOR ART)
FIG. 1 is a perspective view of a conventional card edge connector.
Figure 2:
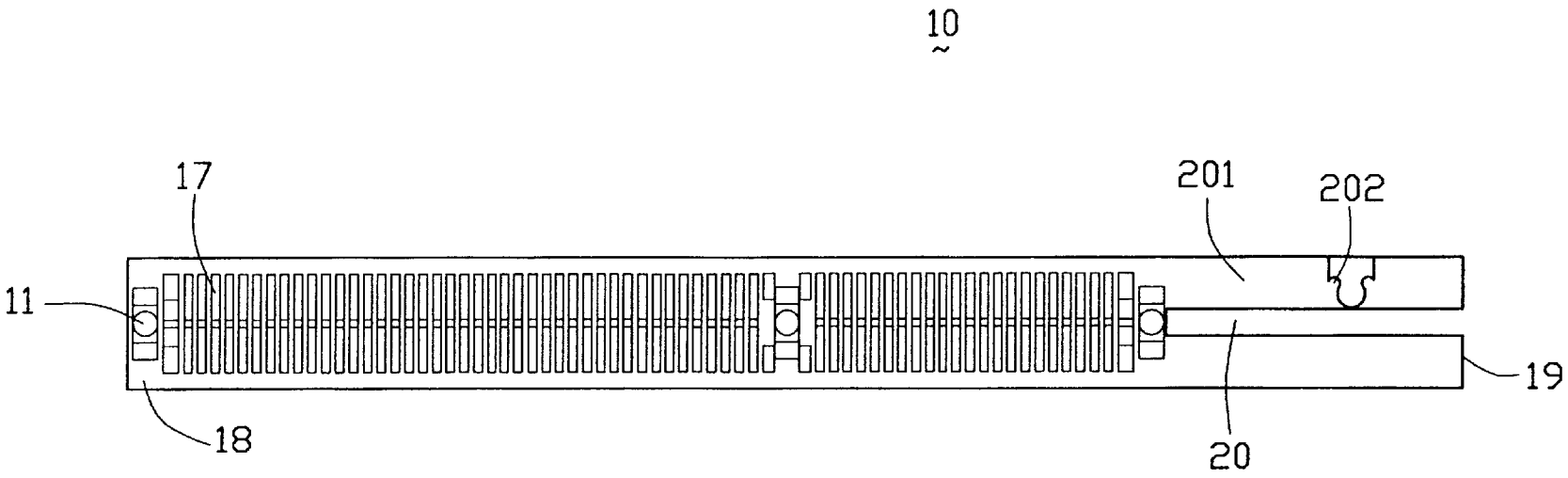
FIG. 2 is a bottom view of a housing of a card edge connector constructed in accordance with the present invention.
Figure 3:
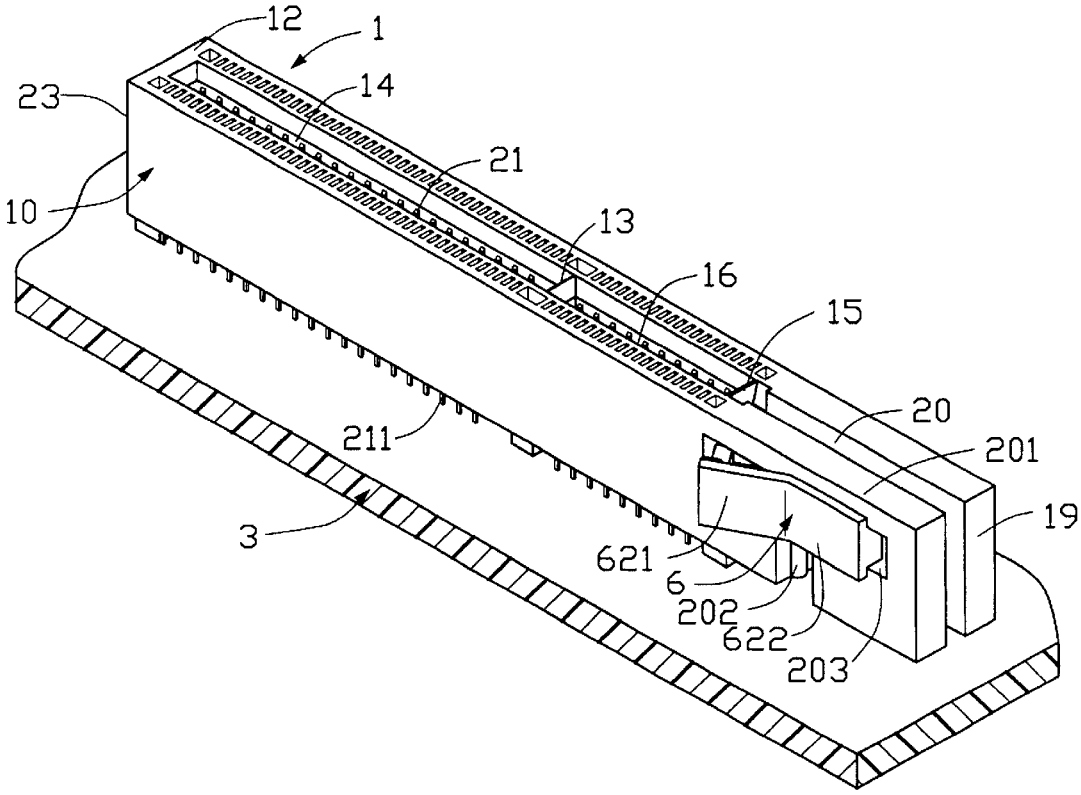
FIG. 3 is a perspective view of the card edge connector of the present invention mounted on a mother board.
Figure 5:
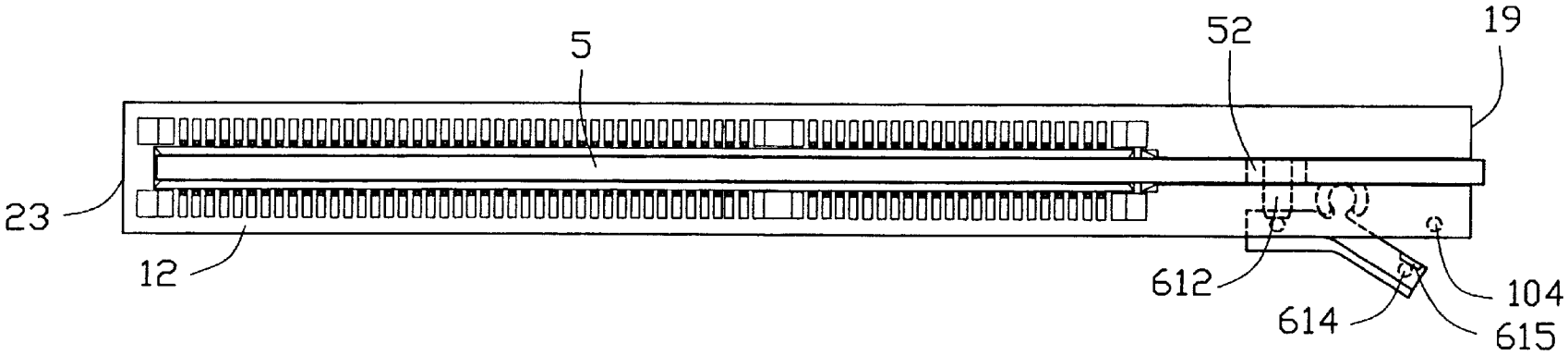
FIG. 5 is a top view of the card edge connector of the present invention with a daughter board received therein.

With reference to the drawings and in particular to FIGS. 3 and 5, a card edge connector constructed in accordance with the present invention, generally designated with reference numeral 1, comprises an elongate housing 10 (particularly shown in FIG. 2) to be mounted to a mother board 3. The housing 10 is made of an insulative material with an elongate slot 14 defined therein for receiving a daughter board 5. Two transverse ribs 13, 15 are formed in the slot 14 and connecting between side walls 16 of the slot 14. Conductive contacts 21 are retained in the housing 10 on opposite sides of the slot 14. The contacts 21 partially project beyond the side walls 16 and into the slot 14 for electrically engaging conductive pads (not shown) formed on the daughter board 5. Each contact 21 has a tail 211 extending beyond a bottom face 18 of the housing 10 through an opening 17 defined in the bottom face 18 for being soldered to the mother board 3 as shown in FIG. 3.

Positioning posts 11 extend from the bottom face 18 of the housing 10 for engaging holes (not shown) defined in the mother board 3 to properly position the connector 1 on the mother board 3.

The housing 10 has first and second ends 19, 23. The first end 19 is extended in a direction away from the housing 10 and defining a secondary slot 20 in line with the central slot 14 of the housing 10, serving to accommodate a portion of the daughter board 5. Thus the first end 19 is divided by the secondary slot 20 into two blocks 201. In one of the blocks 201, a cavity 203 is defined in a side surface of the block 201. A pivot socket 202 is formed inside the cavity 203 and preferably extending to the bottom face 18 of the housing 10 along and inside a channel (not labeled) between the bottom face 18 and the cavity 203.

Figure 4:
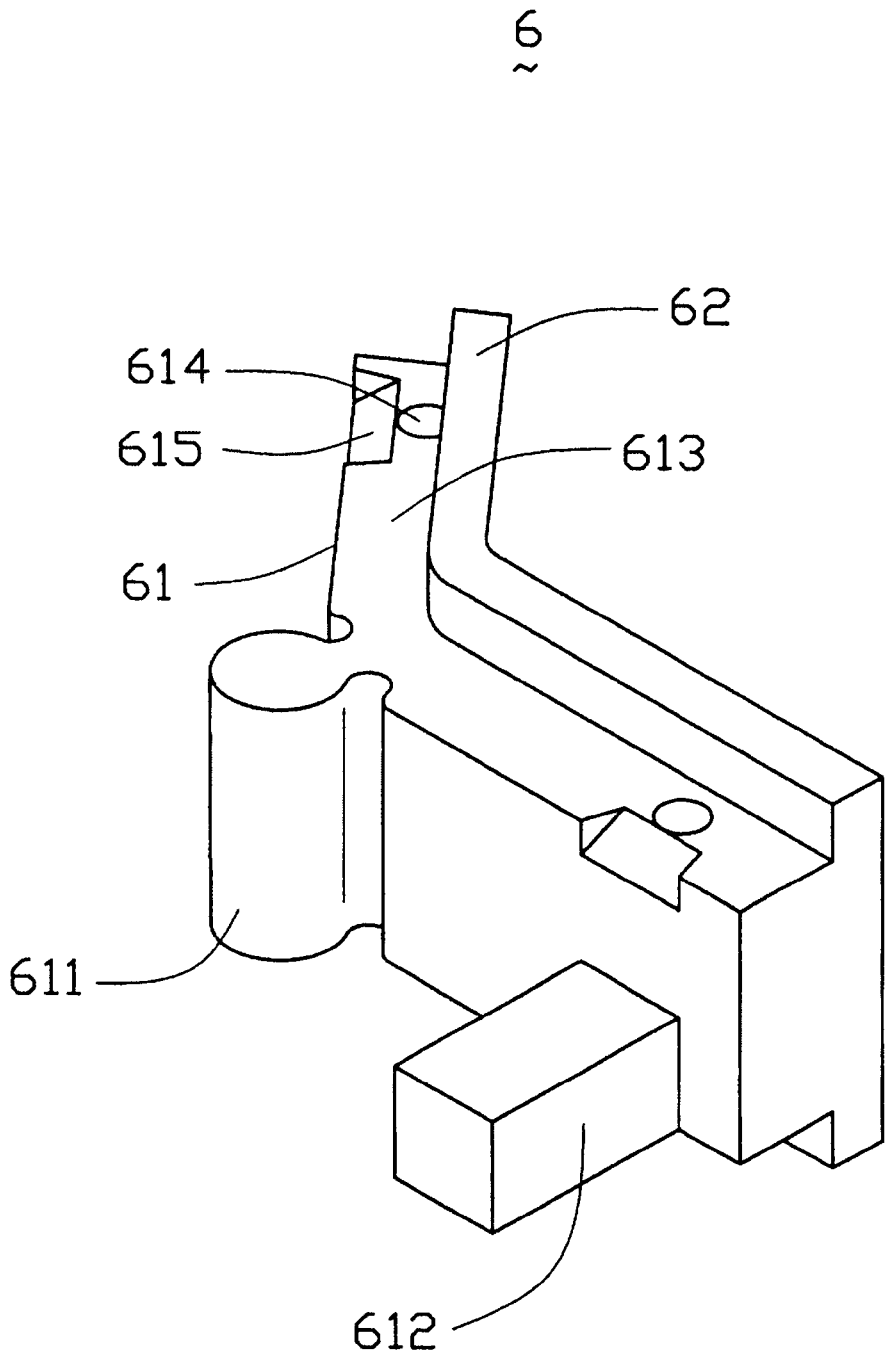
FIG. 4 is a perspective view of a switching button of the card edge connector of the present invention.

Also referring to FIG. 4, a switching button or retainer 6 is movably received in the cavity 203. The switching button 6 comprises a body 62 having two side sections 621, 622 connected to each other and forming an included angle therebetween whereby the side sections 621, 622 are inclined with respect to each. A pivot 611 is formed in the connection of the side sections 621, 622. The pivot 611 is rotatably received and retained in the pivot socket 202 of the cavity 203 for allowing the switching button 6 to move, by means of rotation about the pivot 611, between a locking position and a released position (FIG. 3). In the embodiment illustrated, the pivot 611 is a cylindrical projection having a side surface mounted to the body 62 with a neck therebetween. The socket 202 comprises two opposing arc projections formed on in the cavity 203 with a gap therebetween for receiving and retaining the cylindrical projection between the arc projections as clearly shown in FIG. 5. It is understood that the pivotal joint can be replaced by other suitable pivotable connection, such as a spherical joint.

A latch pin 612 is formed on the side section 621 of the body 62 whereby when the switching button 6 is at the locking position, the side section 621 is moved into the cavity 203 to drive the latch pin 612 to engage a corresponding hole or notch 52 defined in the daughter board 5 thereby securing the daughter board 5 in the connector 1. When the switching button 6 is moved, by means of rotation about the pivot 611, to a released position as shown in FIG. 3, the side section 622 is moved into the cavity 203 while the side section 621 is moved out of the cavity 203, thereby disengaging the latch pin 612 from the notch 52 of the daughter board 5 and thus allowing the daughter board 5 to be detached from the connector 1.

Preferably, side flanges 61 are formed along upper and lower sides of the body 62. The side flanges 61 are dimensioned to contact outer surface of the block 201 when the side sections 621, 622 are selectively moved into the cavity 203.

A dimple 614 is defined in a side face 613 of each side section 621, 622. Corresponding to the dimples 614, bosses 104 are formed inside the cavity 203 for selectively snapping on the dimples 614 when the side sections 621, 622 are selectively moved into the cavity 203. Preferably, an inclination 615 is formed in each side section 621, 622 and corresponding to each dimple 614 for guiding the corresponding boss 104 into the dimple 614. The engagement between the dimple 614 and the corresponding boss 104 ensures the corresponding side section 621, 622 can be securely retained in the cavity 203 without undesired separation from the cavity 203.

Although the present invention has been described with reference to the preferred embodiment thereof, it is apparent to those skilled in the art that a variety of modifications and changes may be made without departing from the scope of the present invention which is intended to be defined by the appended claims. For example, the retainer 6 may be arranged to slidably move relative to the housing 10 instead of rotated movement, if the body 62 owns somewhat resiliency, to have the latch pin 612 locking into the notch of the inserted circuit board.

What is claimed is:

1. An electrical connector comprising:

an insulative housing defining a slot adapted to receive a circuit board in a vertical direction thereof, the housing defining a cavity in a side surface thereof, conductive contacts retained in the housing for being electrically engageable with the circuit board;

a switching button comprising first and second side sections connected to each other and extending away from;each other in such a way to be inclined with respect to each other, the button being received in the cavity and coupled thereto by a rotation joint to allow the button to be rotatable between a first position where the first side section is moved into the cavity while the second side section is moved out of the cavity and a second position where the second side section is moved into the cavity while the first side section is moved out of the cavity; and a latch pin extending from the first side section wherein when the button is at the first position, the latch pin is adapted to engage with a notch defined in the circuit board to secure the circuit board in the connector and when the button is at the second position, the latch pin is adapted to disengage from the notch to release the circuit board;

wherein the rotation joint comprises a socket formed inside the cavity and a pivot formed on the connection between the side sections of the button, the pivot being rotatable received and retained in the socket;

wherein a pivot axis of said button extends along said vertical direction.

2. The electrical connector as claimed in claim 1, wherein a channel is defined in the side surface of the housing, extending from the cavity to a bottom face of the housing, the socket being defined by two opposite arc sections which extend from the cavity to the bottom face of the housing along and inside the channel.

3. The electrical connector as claimed in claim 1, which a side flange is formed along one side of the button for contacting the side surface when the button is selectively moved to the first and second positions.

4. The electrical connector as claimed in claim 3, wherein side flanges are formed along upper and lower sides of the button.

5. The electrical connector as claimed in claim 1, wherein a dimple is formed in an upper face of each side section for engaging with a boss formed inside the cavity to secure the button in the corresponding first and second positions.

6. The electrical connector as claimed in claim 5, wherein each side section forms an inclination corresponding to the dimple for guiding the corresponding boss into engagement with the dimple.

7. An electrical connector assembly comprising:

an insulative housing defining a central slot with a plurality of contacts by at least one side thereof; and a discrete retainer moveably disposed on and associated with a block located adjacent one end of the housing, said retainer including a latch pin; wherein when said retainer is in a first position, the latch pin is away from a locking position; when said retainer is in a second position, the latch pin is inserted into the locking position for latchable engagement within a notch of a printed circuit board received within the central slot in a vertical direction thereof;

wherein said retainer is pivotally moved relative to said housing;

wherein a pivot axis of said retainer extends along said vertical direction.

8. The connector assembly as claimed in claim 7, wherein the retainer defines an elongated body extending along a longitudinal direction of said central slot, and said elongated body defines thereof a horizontal plane along which the retainer moves.

9. The connector assembly as claimed in claim 8, wherein the latch pin is located around one end of said body.

10. The connector assembly as claimed in claim 8, wherein said retainer is pivotally moved relative to the housing and said pivot axis thereof is perpendicular to said horizontal plane.

11. The connector assembly as claimed in claim 10, wherein said printed circuit board is positioned under said housing, and said pivot axis is perpendicular to said printed circuit board.

12. An electrical connector comprising:

an insulative housing defining therein a central slot along a longitudinal direction thereof;

a plurality of terminals disposed by two sides of the central slot for insertion of a printed circuit board in a vertical direction thereof;

a block integrally extending outwardly from one end of said housing; and a discrete retainer pivotally mounted to said block with a latch pin thereof;

wherein a pivot axis of said retainer extends along said vertical direction.

13. The connector as claimed in claim 12, wherein said latch pin is positioned between the central slot and the pivot axis along said longitudinal direction when said retainer is in a locking position.

14. The connector as claimed in claim 12, wherein said retainer is substantially exposed to an exterior for easy access in a lateral direction perpendicular to both said longitudinal direction and said vertical direction.

* * * * *